US005472272A

United States Patent [19]

Hoffman

[11] Patent Number: 5,472,272

[45] Date of Patent: Dec. 5, 1995

[54] PRECISION DRAWER SLIDE MEMBER

[75] Inventor: Keith A. Hoffman, Hudsonville, Mich.

[73] Assignee: Knape & Vogt Manufacturing Company, Grand Rapids, Mich.

[21] Appl. No.: 233,531

[22] Filed: Apr. 26, 1994

Related U.S. Application Data

[63] Continuation of Ser. No. 932,718, Aug. 20, 1992.

[51] Int. Cl.[6] ..... A47B 88/00

[52] U.S. Cl. ..... 312/334.11; 312/334.17

[58] Field of Search ..... 312/334.11, 334.15, 312/334.17, 334.38, 334.25, 334.26, 334.33, 334.9, 334.37; 384/18

[56] References Cited

U.S. PATENT DOCUMENTS

| | | | |
|---|---|---|---|
| 2,370,861 | 3/1945 | Jakeway | 384/18 |
| 2,649,346 | 8/1953 | Wcina et al. | 384/18 |
| 3,451,730 | 6/1969 | Krispinsky et al. | 384/18 |
| 4,200,342 | 4/1980 | Fall | 312/334.9 |
| 4,423,914 | 1/1984 | VanderLey | 312/333 |
| 4,662,761 | 5/1987 | Hoffman | 384/18 |

FOREIGN PATENT DOCUMENTS

| | | | |
|---|---|---|---|
| 334982 | 2/1959 | Switzerland | 312/334.11 |
| 620460 | 3/1949 | United Kingdom | 312/334.11 |

*Primary Examiner*—Kenneth J. Dorner
*Assistant Examiner*—Janet M. Wilkens
*Attorney, Agent, or Firm*—Price, Heneveld, Cooper, DeWitt & Litton

[57] ABSTRACT

A drawer rail assembly having at least an outer rail, an inner rail, and ball bearings enabling relative extension therebetween, said rails having vertical legs and generally horizontally extending, arcuate, radiused legs forming bearing races. At least the lower, generally horizontally extending leg of the outer race has an integral buttress leg or extension which protrudes at an obtuse angle from the arcuate portion and has two sections, namely an intermediate section at an obtuse angle to the end of the arcuate portion, and a terminal section at an obtuse angle to the intermediate section.

5 Claims, 1 Drawing Sheet

PRECISION DRAWER SLIDE MEMBER

This is a continuation of copending application Ser. No. 07/932,718, filed on Aug. 20, 1992.

FIELD OF THE INVENTION

The present invention relates to precision drawer slides, and more specifically to an improvement in the channel member, particularly the outer channel member of precision drawer slides.

BACKGROUND OF THE INVENTION

Drawer slides have long been recognized as the best means by which durable, smooth-acting and quiet operation can be achieved. The drawer slide industry has increased in importance as a result of a corresponding increase in the demand for high quality residential and office furniture. The response by the drawer slide industry has been continuous improvement in the supporting technology of drawer slide design.

The usage of drawer slides in various applications has resulted in an industry specific designation of "precision" drawer slides which are generally viewed as those slides used in the more demanding applications. These particular uses include, among others, drawers in file cabinets (both vertical and lateral) and desk drawers, especially where the carrying weight expected to a pair of slides is in excess of 80 or 90 pounds. While the designation itself may not be "precise," the construction of the drawer slides in this category is precise. In order to meet the functional demands of the more demanding applications, it has been found that precision construction of the drawer slide is a necessity. Only by reducing tolerances of the many components that make up the final product can the appropriate "fit" and "feel" that is deemed acceptable in the industry be achieved.

Generally, drawer slide design in the precision category has evolved into the usage of ball bearings contained within telescoping channel members. This design has fairly met the challenge of achieving both the "fit" and "feel," as well as standing up to the desired weight loadings. The channel construction, as will be explained further within the present application, has typically been formed in such a way as to provide a raceway for the bearings to travel in. This contributes to the controlled transitioning of the slide in operation while retaining the ability to spread the loading on the ball bearings. While many variations on this theme are known in the art, the fundamental approach to the design of these ball bearing precision drawer slides has remained substantially as described.

The aforementioned ball bearing precision slide is not without its limitations. The failure mode of these slides has been studied with the result that the effects of exceeding the rated loadings are becoming known. This overload condition can occur in both a vertical and lateral manner and is quite often the sole cause behind slide failures. The industry has long suffered under the limitations of the prevailing drawer slide designs, even to the point where an ad hoc nomenclature has been applied to these products, identifying them by weight limitations, e.g., "75 pound class," "100 pound class," etc.

More specifically, classic failure of the lower arcuate track of a slide, particularly the outer axial end of the cabinet slide, is exhibited by the so-called "opening up" or "unrolling" of the lower arcuate ball track. This ball track, arcuate in cross section, exhibits a condition where the free lateral edge portion of the arc straightens out so as to be basically tangential to the arcuate curve. As a result, the slide does not retain the end ball bearings up in alignment with the other ball bearings. This allows the opening and/or open drawer to slope downwardly toward the outer end, and destroys effective, smooth operation of the slide. It is not uncommon for failure to occur even after only about 25,000–30,000 cycles.

The present invention relates to an improved unique channel design that has been found to correct the aforementioned failure condition.

SUMMARY OF THE INVENTION

It is an object of the present invention to improve the durability, "fit" and "feel, " and the potential for increased loadings of precision drawer slides, correcting the classic "unwrapping" or "unrolling" of the lower slide arcuate ball track.

It is also an object of the present invention to provide such an improved design that is compatible with mass manufacturing techniques.

Another object of the present invention is to provide a design that not only achieves the foregoing advantages, but also is subject to manufacturing within the tolerances normally found in precision drawer slide products.

These and other useful objects of the present invention will be discussed further within this application.

A new precision drawer slide member in accordance with the present invention comprises a unique cross-sectional shape of a drawer slide, especially suited for an outer member of a precision drawer slide. It includes a ball race defined by an inner, vertical leg; an arcuate, generally horizontal leg having a radius and a novel, outer buttress leg. The arcuate leg provides a concave, arcuate rolling surface compatible with the travel of a ball bearing, typically somewhat larger in radius than the ball radius. The outer buttress leg further includes a transition section at an obtuse angle to the arcuate leg, and an outer end or terminal section at an obtuse angle to the transition section, resulting in an integral overall extended portion from the arcuate leg and extending along its length. The transition section and the end section, in obtuse angular relation to each other and to the arcuate leg, project upwardly from the end of the arcuate section, when applied to the lower leg of the rail, and are integral therewith.

DETAILED DESCRIPTION OF THE PREFERRED EMBODIMENT

Figure 1:
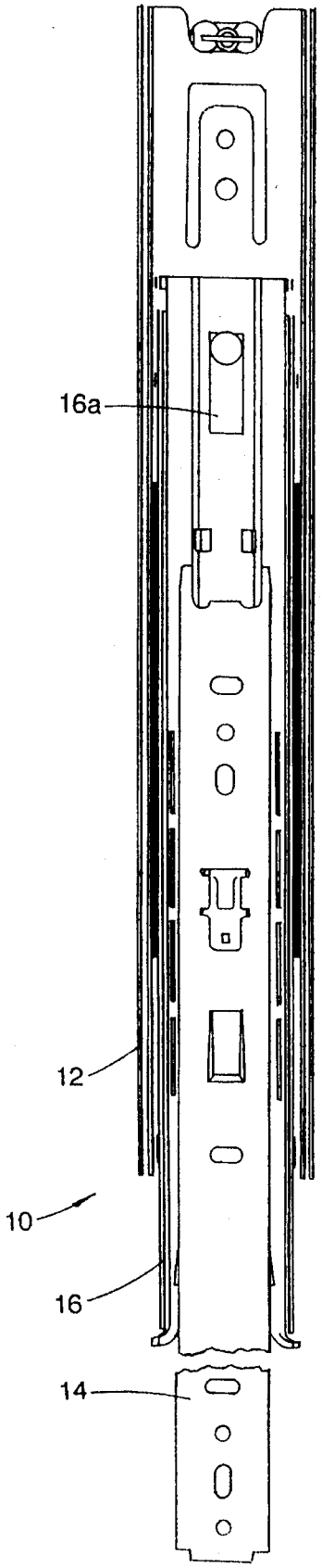
FIG. 1 is an elevational view of a precision drawer slide assembly.

The present invention is an advance over the prior designs of precision drawer slides. While slide components are few in number, the specifications involved, and the manner in which they are brought together, will often mean the difference between a product that equals or surpasses industry performance standards, or one that fails. In order to gain an appreciation for this distinction, it is helpful to make a detailed comparison between the art known and the present invention.

A precision drawer slide, i.e., slide assembly 10, includes an outer rail or channel 12 and an inner rail or channel 14, and preferably, but not necessarily, an intermediate channel 16. Normally two drawer rail assemblies are found for each application wherein the outer channel is usually fastened to the sides of the structure on either side of a drawer opening, for example in a cabinet or desk or some other type of furniture, and therefore the outer rail is typically called a cabinet rail. The inner channel or rail is usually fastened on each side of the drawer and therefore is typically called a drawer rail. Sometimes the outer rail is attached to the drawer, however, and the inner rail is attached to the cabinet. There is telescopic movement between the rails during opening and closing of the drawer slide assembly. Preferably, an intermediate rail is placed between the outer and inner rails. The intermediate rail, if used, moves one-half the distance and rate of the drawer rail during this action. For convenience, only one drawer rail assembly is described in detail herein, it being realized that another drawer rail assembly identical in terms of features, function, performance and application will be arranged in mirror image to the one shown and described.

The depicted embodiment is described herein as for a conventional horizontal drawer, where the slide assemblies have their long dimension horizontal and their short dimension vertical, with the width being lateral, i.e., horizontal. It should be realized, however, that the slide assemblies could be arranged with their short dimension horizontal so that the two slide assemblies are above and below each other. Thus, the use of "vertical," "horizontal," and "lateral" herein to describe the illustrated embodiment should not be taken as limiting the scope of the invention.

In the preferred embodiment depicted, the outer rail 12 is separated from the intermediate rail 16 by a plurality of ball bearings 18 arranged in spaced relationship along the rail, retained by a conventional bearing retainer 20. A duplicate set of the ball bearings and retainer is at the top and bottom of the outer rail.

The outer rail 12 typically has a generally C-shaped overall configuration including an elongated vertical panel or leg **12*a* for mounting to the cabinet, an upper leg 12*b* extending generally horizontally to leg 12*a* and defining a downwardly facing, concave ball track to be described, and a lower leg 12*c* extending generally horizontally from leg 12*a* and defining a second upwardly facing concave ball track to be further described. The intermediate rail also has a generally C-shaped overall configuration including a vertical panel 16*a*, an upper, generally horizontally extending leg 16*b* which has an upwardly facing, concave ball track therein cooperative with the ball track of leg 12*b*, and a lower leg 16*c* which extends generally horizontally and has a downwardly facing ball track 32 at the bottom surface thereof cooperative with the ball track in leg 12*c*. The drawer rail 14 also preferably has a generally C-shaped cross-sectional configuration, typically being oriented opposite to the C shapes of the other two, having a vertical panel or leg 14*a* for mounting to a drawer side wall, an upper, generally horizontally extending leg 14*b* forming an upwardly facing ball track 34' therein, and a lower, generally horizontally extending leg 14*c* forming a downwardly facing ball track 34** therein.

The horizontally extending lower leg **12*c* of cabinet rail or outer rail 12 includes an inner portion with an arcuate, elongated, upwardly-facing, concave, ball track 22 with a radius slightly larger than the radius of the balls 18 therein, and engaging the lower portion of the balls 18, preferably on a one-point contact. A similar downwardly facing ball track 22' is in the upper leg 12*b* of the outer race. In the upper end of intermediate rail 16, specifically in the upper leg 16*b* thereof, is an upwardly facing concave elongated arcuate ball race or track 24' cooperative with downwardly facing race 22' to restrain the lateral movement of upper balls 18' therebetween. A downwardly facing ball track 24 in the lower surface of lower leg 16*c* of intermediate rail 16 cooperates with ball track 22 to laterally restrain ball bearings 18**.

Upper and lower sets of ball bearings 28 and 28' are likewise restrained between the intermediate rail 16 and the drawer rail 14. Specifically, these bearings which are held in place by a retainer 30 which extends between and spaces the lower bearings 28 and up to and between the upper bearings 28'. Upper bearing 28' are restrained between downwardly arcuate concave ball track 32' in the lower surface of leg **16*b* and the upwardly concave elongated ball track 34' in leg 14*b* to restrain upper balls 28'. Likewise, the upwardly oriented concave elongated ball track or race 32 in lower leg 16*c* cooperates with downwardly facing concave ball tracks 34 in leg 14*c* to restrain ball bearings 28**.

Figure 2:
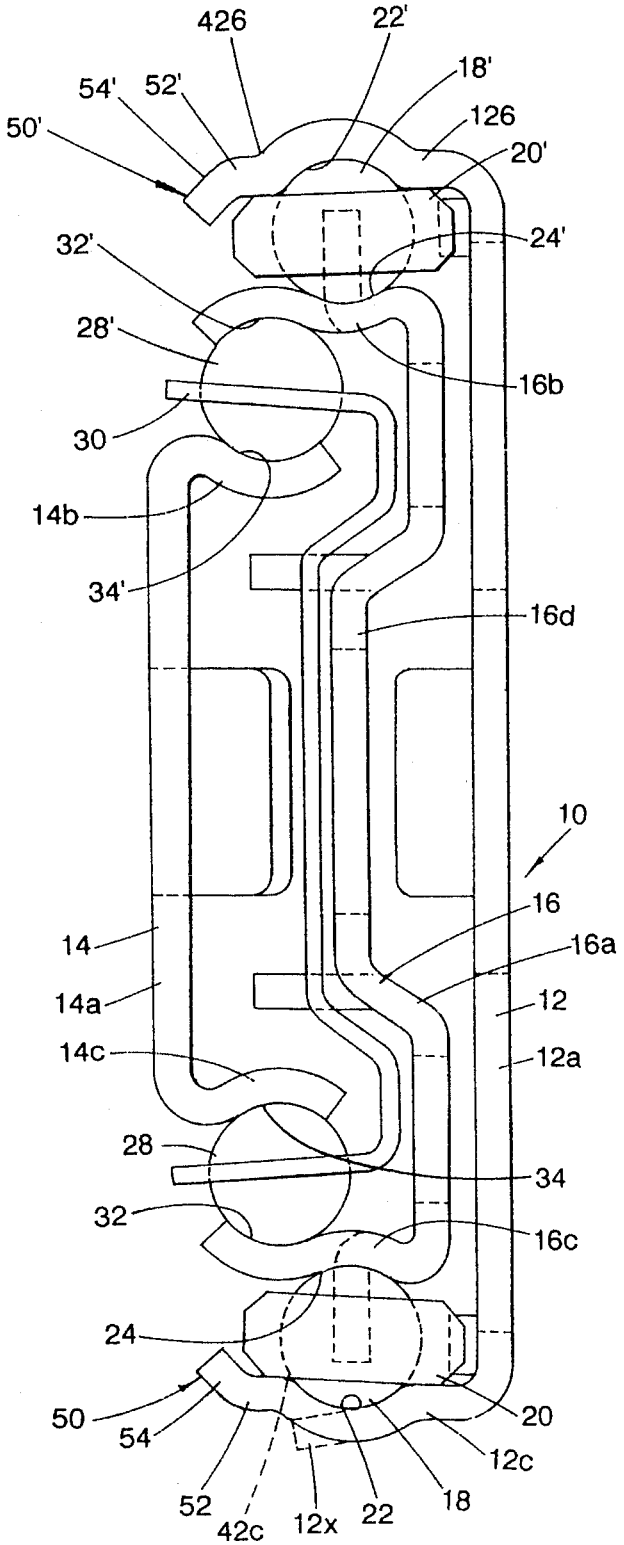
FIG. 2 is a cross-sectional view of the drawer slide assembly embodying the invention.

The invention as illustrated herein is particularly applied to the upper and lower legs of the outer rail or channel 12. It can also be incorporated into the other rails, but it is not as crucial there. For example, if the inner rail is attached to the cabinet, the maximum force may be applied to the inner rail track edge, such that it would be advisable to incorporate the novel buttress configuration to it. Specifically, for the assembly as illustrated, the inventor has found it to be highly significant to provide a special buttress leg extension or outer portion extending from, integral with, and at an angle to the end of the arcuate portion of at least the lower leg **12*c*, and preferably also upper leg 12*b* of rail 12. More specifically, referring to FIG. 2, there is shown on the lower leg a dashed line 42*c*, and on the upper leg a dashed line 42*b*, which would normally be the terminal ends of the leg 12*c* and leg 12*b* on a conventional rail. Classic failure of the drawer slide will typically occur in most pronounced fashion on the outer rail, typically on the axially outer end portion of the outer rail where the cantilever loads are greatest, and especially on the lower leg 12*c* thereof. Specifically, classic failure occurs by the tendency for the arcuate curved structure to "unwrap," i e., "open up," by the arcuate portion uncurling to extend basically tangentially to the periphery of the bearing ball 18, as indicated by the phantom lines at 12*x* in FIG. 2**. This type of failure is believed to result primarily from lateral forces applied by the balls to the rail. It is believed that a ramping action occurs by each ball on the end portion of the arc, with great stress being applied to this cantilevered end portion of the leg, particularly the lower leg, and particularly at the axially outer end thereof where the load is so great when a drawer is fully open. As this uncurling deformation occurs on the rail track, the ball bearings have even more lateral freedom which accentuates and accelerates the rate of deformation, resulting ultimately in failure of the assembly.

The unique buttress extension leg configuration of this invention has been remarkable in its capacity to extend the useful life of the rail assembly. Extensive testing has shown that, for example, a competitive structure without the special configuration tended to fail even at 25,000–30,000 cycles of the drawer assembly. In contrast, the novel configuration was effectively cycled for over 250,000 cycles and still showed no perceptible deformation.

The buttress leg preferably has two parts, namely an intermediate buttress leg section extending from, integral with, and at an angle other than 0° (see FIG. 2), and preferably at an obtuse angle from the end of the arcuate portion of the leg, i.e., at an angle to a plane which is tangential to the endmost arcuate portion and a terminal or end buttress leg section 54 integral with and extending outwardly from intermediate section 52, at an obtuse angle thereto, the two sections being integral and combining to form the buttress 50. An obtuse angle is an angle greater than 90° and less than 180° . This buttress preferably extends the full length of the rail, but is most effective toward the outer end portion thereof. This lower leg buttress extends outwardly and upwardly. In similar fashion, upper leg **12*b* is shown to be provided with a like mirror image buttress leg 50' formed of an intermediate section 52' and an outer terminal section 54' both integral with the arcuate portion of leg 12*b*, with section 52' being at an obtuse angle to the arcuate portion and section 54' being at an obtuse angle to the intermediate section, thereby projecting downwardly-outwardly as opposed to the upwardly-outwardly projecting nature of buttress leg 50**. The two obtuse angles depicted are approximately 150°.

Although it is not completely known exactly how this buttress leg serves so effectively to extend useful life of the precision drawer slide assembly, it is theorized that as the individual ball moves along the race or track, it has, under lateral stress, a tendency to successively bend the outer portion of the conventional arcuate race to a larger and larger arc and eventually to an almost straight deformed configuration. The individual area where a particular ball is applying stress is reinforced not only by the buttress leg portion immediately adjacent thereto, but also by the adjoining buttress leg portions axially spaced therefrom. Those in the field may think of more sophisticated stress analysis reasons for the surprising results achieved by this change which initially appears so minor. Applicant does not intend to be bound to his particular theoretical explanation.

While the embodiment depicted is presently the preferred embodiment, including the obtuse angular arrangement of the two sections 52 and 54, it is conceivable that further experimentation by those in the art will show a particular angle other than that illustrated which is at least equally effective in achieving the novel results.

Hence, these and other variations in the novel preferred construction set forth as the preferred embodiment could be made within the concept presented without departing from the scope of the invention which is intended to be limited only by the scope of the appended claims and the reasonably equivalent structures to those defined therein.

The embodiments of the invention in which an exclusive property or privilege is claimed are defined as follows:

1. An elongated drawer rail comprising:

a vertical mounting leg;

a generally horizontally extending lower leg integral with said vertical mounting leg, said lower leg including an inner portion that includes an arcuate, concave, upwardly-facing, elongated ball race along its length, said lower leg including an outer portion extending outwardly from the endmost section of said lower leg inner portion; and said lower leg outer portion having an intermediate section extending from and at an angle other than 0° to a plane tangential to the endmost section of said lower leg inner portion, and a terminal section at an angle other than 0° to said intermediate section, whereby said lower leg intermediate section and said terminal section reinforce said ball race against deformation.

2. An elongated drawer rail comprising:

a vertical mounting leg;

a generally horizontally extending lower leg integral with said vertical mounting leg and including an inner portion having an arcuate, concave, upwardly-facing, elongated ball race along its length;

said lower leg including an outer buttress portion extending outwardly from said lower leg inner portion;

said lower leg outer buttress portion having an intermediate section extending from and at an angle to a plane tangential to the endmost region of said lower leg inner portion, and a terminal section at an angle to said intermediate section, said intermediate section extending at an obtuse angle greater than 90° and less than 180° to said tangential plane of said lower leg inner portion and said terminal section being at an obtuse angle greater than 90° and less than 180° to said intermediate section, whereby said lower leg outer buttress portion provides resistance to deformation of said ball race.

3. A drawer rail assembly comprising:

at least an elongated inner rail, an elongated outer rail, and bail bearings enabling axial extension of said inner rail relative to said outer rail;

said inner rail and said outer rail each having a vertical mounting panel leg, an upper, generally horizontally extending leg, and a lower, generally horizontally extending leg;

said upper leg and said lower leg of each rail having an inner portion including elongated, concave, ball tracks for ball bearings for enabling smooth extension and contraction of said rail assembly; and at least said lower leg of one of said inner and outer rails having an outer buttress portion extending from said inner portion;

said outer buttress portion having an intermediate section extending from and at an angle other than 0° to a plane tangential to the endmost portion of said lower leg inner portion, and a terminal section at an angle other than 0° to said intermediate section, whereby said outer buttress portion provides resistance to deformation of said ball track of said at least said lower leg.

4. The drawer rail assembly in claim 3 wherein said buttress leg is on the lower leg of said outer rail.

5. A drawer rail assembly comprising:

at least an elongated inner rail, an elongated outer rail, and ball bearings enabling axial extension of said inner rail relative to said outer rail;

said inner rail and said outer rail each having a vertical mounting panel leg, an upper, generally horizontally extending leg, and a lower, generally horizontally extending leg;

said upper leg and said lower leg of each rail having elongated, concave, ball tracks for ball bearings for enabling smooth extension and contraction of said rail assembly; and at least said lower leg of one of said inner and outer rails having an inner portion in which said ball track is disposed, and a buttress leg portion extending from said inner portion;

said buttress leg portion having an intermediate section extending from and at an angle to a plane tangential to the end of said lower leg inner portion and a terminal section at an angle to said intermediate section, said intermediate section extending at an obtuse angle greater than 90° and less than 180° to said tangential plane and said terminal section being at an obtuse angle greater than 90° and less than 180° to said intermediate section, whereby said buttress leg portion provides resistance to deformation of said ball track of said inner portion.

* * * * *